US010577848B2

(12) United States Patent
Rodems et al.

(10) Patent No.: US 10,577,848 B2
(45) **Date of Patent: *Mar. 3, 2020**

(54) POWERED ACTUATOR

(71) Applicant: Caldwell Manufacturing Company North America, LLC, Rochester, NY (US)

(72) Inventors: Eric Rodems, Spencerport, NY (US); Robert M. Lucci, Rochester, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 115 days.

This patent is subject to a terminal disclaimer.

(21) Appl. No.: 15/905,035

(22) Filed: Feb. 26, 2018

(65) Prior Publication Data

US 2018/0187471 A1 Jul. 5, 2018

Related U.S. Application Data

(63) Continuation of application No. 15/263,813, filed on Sep. 13, 2016, now Pat. No. 9,903,148.

(Continued)

(51) Int. Cl.

*E05F 11/34* (2006.01)
*E05F 15/652* (2015.01)

(Continued)

(52) U.S. Cl.

CPC ..... *E05F 15/652* (2015.01); *E05D 15/06* (2013.01); *E05D 15/08* (2013.01); *E05F 15/665* (2015.01);

(Continued)

(58) Field of Classification Search

CPC ..... E05F 15/652; E05F 15/665; E05D 15/08; E05D 15/06; E05Y 2900/148;

(Continued)

(56) References Cited

U.S. PATENT DOCUMENTS 1,571,819 A * 2/1926 Toresan ..... E05F 11/40 49/136
2,256,905 A * 9/1941 Moss ..... E05F 11/42 49/362

(Continued)

FOREIGN PATENT DOCUMENTS

CA 2942126 A1 3/2017
GB 2242225 A * 9/1991 ..... E05F 15/665

(Continued)

OTHER PUBLICATIONS

Extended European Search Report for EP 16188853.2, dated Feb. 10, 2017; EPO.

*Primary Examiner* — Jerry E Redman

(74) *Attorney, Agent, or Firm* — Harness, Dickey & Pierce, P.L.C.

(57) ABSTRACT

A sliding closure assembly includes a frame assembly, at least one sliding closure panel, a second panel, and a powered actuator. The frame assembly has a first track portion, a second track portion, and a catch portion. The sliding closure panel slides within the first track portion of the frame assembly. The second closure panel is adjacent to the at least one sliding closure panel and is positioned within the second track portion of the frame assembly. The sliding closure panel slides within the first track portion of the frame such that an opening is formed through the sliding closure assembly when the sliding closure panel is in the opened position and the opening is closed when the sliding closure panel is in the closed position.

19 Claims, 5 Drawing Sheets

Related U.S. Application Data

(60) Provisional application No. 62/218,811, filed on Sep. 15, 2015.

(51) Int. Cl.

| | |
|---|---|
| ***E06B 3/46*** | (2006.01) |
| ***E05D 15/06*** | (2006.01) |
| ***E05D 15/08*** | (2006.01) |
| ***E05F 15/665*** | (2015.01) |

(52) U.S. Cl.

CPC ..... *E06B 3/4636* (2013.01); *E05Y 2201/434* (2013.01); *E05Y 2201/696* (2013.01); *E05Y 2201/71* (2013.01); *E05Y 2600/45* (2013.01); *E05Y 2800/17* (2013.01); *E05Y 2800/205* (2013.01); *E05Y 2900/132* (2013.01); *E05Y 2900/148* (2013.01)

(58) Field of Classification Search

CPC ..... E05Y 2900/132; E05Y 2800/205; E05Y 2600/45; E05Y 2201/696

USPC ..... 49/360, 362

See application file for complete search history.

(56) References Cited

U.S. PATENT DOCUMENTS 3,324,594 A * 6/1967 Hettinger ..... E05F 15/665 49/28
3,330,071 A * 7/1967 Kubisiak ..... E05F 11/40 49/362
3,890,744 A 6/1975 Galis
4,067,144 A 1/1978 Ogishi
4,927,198 A * 5/1990 Fennell ..... E05B 65/0888 16/66
5,301,734 A * 4/1994 Opel ..... E05D 15/22 160/100
5,422,552 A * 6/1995 Parisi ..... E05F 15/652 318/466
5,440,837 A * 8/1995 Piltingsrud ..... E05D 15/22 49/139
5,605,013 A * 2/1997 Hogston ..... E05F 15/673 49/31
5,826,377 A * 10/1998 Simson ..... E05D 15/066 49/362
6,115,884 A * 9/2000 DeJong ..... E05D 13/1253 16/197
6,324,788 B1 12/2001 Koneval
6,948,215 B2 * 9/2005 Malek ..... E05D 13/1207 16/197
7,410,201 B1 * 8/2008 Wilson ..... E05F 15/652 296/146.16
7,574,772 B2 * 8/2009 Wellman ..... E05D 13/1207 16/193
8,935,887 B2 1/2015 Cavalcante
9,003,708 B2 4/2015 Shiroma
9,160,220 B2 10/2015 Cavalcante
9,382,745 B2 * 7/2016 Plummer ..... E05F 15/603
9,719,282 B2 8/2017 Bellei
9,903,148 B2 * 2/2018 Rodems ..... E05D 15/08
9,920,821 B2 * 3/2018 Wu ..... F16H 25/20
9,970,225 B2 * 5/2018 Wynder ..... E05D 15/16
2002/0157318 A1 * 10/2002 Teubert ..... A47K 3/30 49/360
2004/0244295 A1 * 12/2004 Derham ..... E05F 15/41 49/362
2006/0150520 A1 * 7/2006 Hamazaki ..... E05B 65/08 49/449
2007/0234644 A1 * 10/2007 Jaeger ..... E05D 15/10 49/362
2007/0277442 A1 * 12/2007 Dery ..... B60J 1/16 49/362
2008/0163553 A1 * 7/2008 Liao ..... E05F 11/423 49/362
2009/0025296 A1 * 1/2009 Petner ..... E05F 15/652 49/130
2010/0122493 A1 * 5/2010 Burrows ..... E05D 13/1207 49/358
2011/0023370 A1 * 2/2011 Zimmer ..... E05F 1/16 49/360
2011/0214349 A1 * 9/2011 Chan ..... E05F 17/00 49/120
2012/0023827 A1 2/2012 Hancock
2012/0167469 A1 * 7/2012 Maltaverne ..... B60J 1/16 49/360
2012/0255232 A1 * 10/2012 Gayhart ..... E05B 65/0017 49/360
2013/0212948 A1 * 8/2013 Nixon ..... E05F 15/00 49/349
2014/0047770 A1 2/2014 Vaknin

FOREIGN PATENT DOCUMENTS

JP 06173528 A 6/1994
WO WO1999/064709 12/1999

* cited by examiner

POWERED ACTUATOR

CROSS-REFERENCE TO RELATED APPLICATIONS

This application is a continuation of U.S. patent application Ser. No. 15/263,813 filed on Sep. 13, 2016. This application claims the benefit of U.S. Provisional Application No. 62/218,811, filed on Sep. 15, 2015. The entire disclosures of each of the above applications are incorporated herein by reference.

FIELD

The subject disclosure relates to a mechanism system for operating a moveable member, in particularly for operating a powered actuator for a sliding closure, such as a door wall or a window.

BACKGROUND

Various windows and doors may be manually opened at a selected time. For example, a sliding door wall, or a sliding window, including a side sliding or a double hung window, can be opened by sliding a sash or pane member in a track. In selected windows, a jamb channel can be formed in a frame member in which the window sash mechanism can slide. In a sliding door a door may ride in a track between an open and closed position. Various handle members may be attached to the frame that holds a window pane to assist in manipulating the door and/or operating a locking mechanism to lock the door.

SUMMARY

A powered actuator is disclosed to provide power at a selected time to open and close a sliding sash or door. For example, a sliding door can include a moveable door or panel portion. A power mechanism can be installed relative to the door and be connected to the door to move the door. The power mechanism can include a motor and a controller to the motor. In various configurations, a door wall may include a movable panel and a fixed panel. The powered actuator may be installed in a track of the fixed panel door so that the dimensions, such as headroom through the door, are not changed. Further, the power mechanism can be installed substantially within the frame work of the door so as not to interrupt or change the dimension of the doorwall. The powered actuator can be installed in a window frame in a similar configuration.

The powered actuator may generally include a motor that can directly drive or drive through a gear transmission system drive a spiral rod to move a movable member. A clutch mechanism can also be provided to engage and disengage the motor from the drive gears. The clutch mechanism can be engaged to drive the power system to open and close the door and the clutch mechanism can be disengaged to allow free movement of the door. Free movement of the door may occur when a user manually opens and closes the door. A control panel, such as push buttons, can be interconnect with a controller of the motor to operate the motor at a user's command.

In one form, a sliding closure assembly includes a frame assembly, at least one sliding closure panel, a second closure member, and a powered actuator assembly. The frame assembly having a first track portion, a second track portion, and a catch portion. The at least one sliding closure panel slides within the first track portion of the frame assembly. The second closure member being adjacent to the at least one sliding closure panel and positioned within the second track portion of the frame assembly. The powered actuator assembly is positioned adjacent to the second closure member and entirely within the second track portion. The at least one sliding closure panel slides within the first track portion of the frame such that an opening is formed through the sliding closure assembly when the at least one sliding closure panel is in the opened position and closed once the at least one sliding closure panel is in a closed position.

In some configurations, the first track portion of the frame assembly comprises a first lower track and a first upper track and the second track portion of the frame assembly comprises a second lower track and a second upper track.

In some configurations, the first lower track of the first track portion and the second lower track of the second track portion are positioned substantially parallel and adjacent to one another along a length of the at least one sliding closure panel.

In some configurations, the first upper track of the first track portion and the second upper track of the second track portion are positioned substantially parallel and adjacent to one another at least over a linear distance the at least one sliding closure panel slides.

In some configurations, the at least one sliding closure panel comprises a closing edge that contacts the catch portion of the frame assembly to close and seal the opening through the sliding closure assembly.

In some configurations, the at least one sliding closure panel includes a pin attached thereto.

In some configurations, the powered actuator assembly is positioned entirely within the second upper track of the second track portion such that the powered actuator assembly does not extend into the opening formed through the sliding closure assembly.

In some configurations, the powered actuator assembly is substantially flush with the second closure member within the second upper track of the second track portion.

In some configurations, the pin is attached to the at least one sliding closure panel such that the pin is positioned between the at least one sliding closure panel and the powered actuator assembly.

In some configurations, the powered actuator assembly extends less than about 0.5 inches to about 2 inches from the second upper track of the second track portion.

In some configurations, the powered actuator assembly is positioned parallel and adjacent to the at least one sliding closure panel when the at least one sliding closure panel is in the opened and closed position;

In some configurations, the powered actuator assembly includes, a motor configured to drive a drive rod, a transmission gear assembly configured to transfer rotational motion of the motor to the drive rod, a clutch assembly selectively coupling the motor and the drive rod, a solenoid assembly interconnected to the motor and operable to move the motor to engage the clutch assembly, a drive block moveable by the drive rod, and a housing to house at least the motor, the transmission gear assembly, the clutch assembly, the solenoid assembly and the drive block.

In some configurations, an engaging member is coupled to the drive block, and the motor is configured to power movement of the engaging member.

In some configurations, a spring is disposed between the motor and the clutch assembly and biases the motor to disengage from the clutch assembly.

In some configurations, the solenoid assembly and motor are operable via wireless transmission systems.

In some configurations, the clutch assembly includes a first clutch and a second clutch.

In some configurations, the first clutch is coupled to an axle of the motor and the second clutch is coupled to the drive rod.

In some configurations, the motor drives the drive rod when the solenoid assembly moves the motor to engage the first clutch and second clutch.

In some configurations, the pin attached to the at least one sliding closure panel is coupled to the engaging member within the frame assembly such that power movement of the engaging member moves the at least one sliding closure panel within the first track portion.

In some configurations, the drive rod extends through a bore in the drive member.

In some configurations, the drive rod includes a spiral that engages the drive block such that rotation of the drive rod in a first direction causes the drive block to move towards one end and rotation of the drive rod in a second direction causes the drive block to move towards an opposing end.

In some configurations, the drive rod spiral has a variable pitch ranging between 0.5 inches and 1.5 inches near each of the first and second ends of the drive rod and a constant pitch of between 1 inch and 4 inches near a middle portion of the drive rod.

In some configurations, each end of the drive rod is received in a slot of a rod coupling assembly such that the drive rod is permitted to move about 1° to about 2° relative to a central axis of the coupling assembly.

In some configurations, the at least one sliding closure panel comprises one of a sliding door panel or a sliding window sash, such as in a side sliding window or in a hung window.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
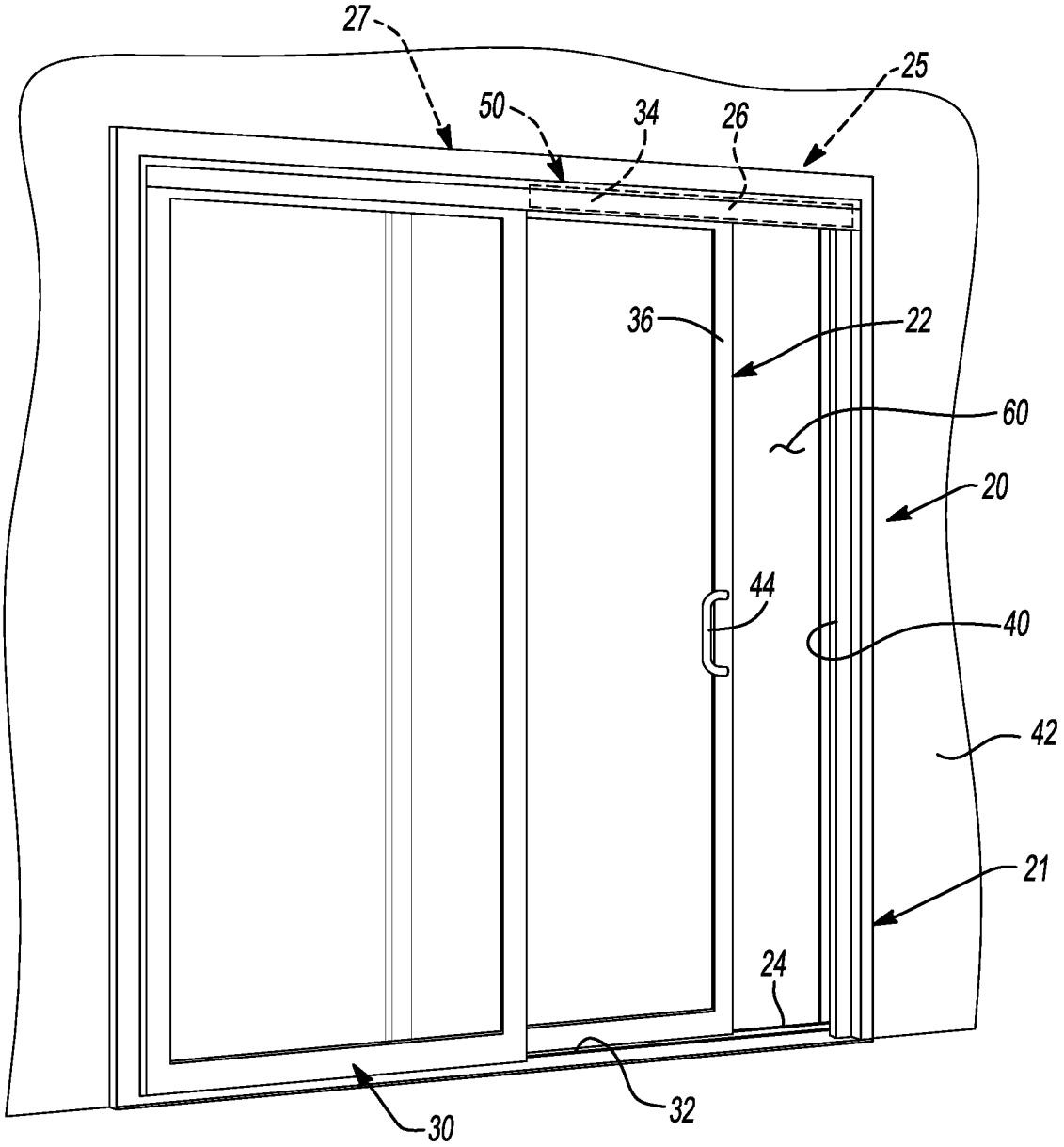
FIG. 1 is an environmental view of a doorwall and a powered actuator.

With reference to FIG. 1 a sliding door wall closure assembly 20 is illustrated. The sliding door wall closure assembly 20 may include at least one moving or sliding closure door panel or member 22. The sliding door member 22 may slide in a frame assembly 21 having a first track portion 25 and a second track portion 27 such that the sliding door wall closure assembly 20 forms an opening 60 therethrough when the door member 22 is in an opened position and the opening 60 is closed when the door member 22 is in a closed position. The door member 22 may slide in the first track portion 25 of the frame assembly 21. The first track portion 25 may include a first lower track 24 and a first upper track 26 that have surface planes intersecting one another. The sliding door wall closure assembly 20 may further include a second closure door member or panel 30. The second door member 30 may be sliding or non-sliding (i.e., stationary). The second door member 30 may be positioned within the second track portion 27 having a second lower track 32 and a second upper track 34. Both the first and second lower tracks 24, 32 can be substantially parallel and adjacent to one another along a length of movement of the moveable door member 22 and along a length that would generally find the opening 60 through the sliding door wall closure assembly 20. Similarly, the first and second upper tracks 26, 34 can be generally parallel and adjacent to one another at least over the area over the door member 22 moves. The moveable door member 22 includes a closing edge 36 to contact the frame assembly 21 to close the opening 60 through the sliding door wall closure assembly 20. The movable door member 22 including the closing edge 36 can close into a seal or catch portion 40 that may be near a wall of a structure 42. The movable door member 22 may further include a handle 44 for grasping and manually operating the movable door 22.

Figure 2:
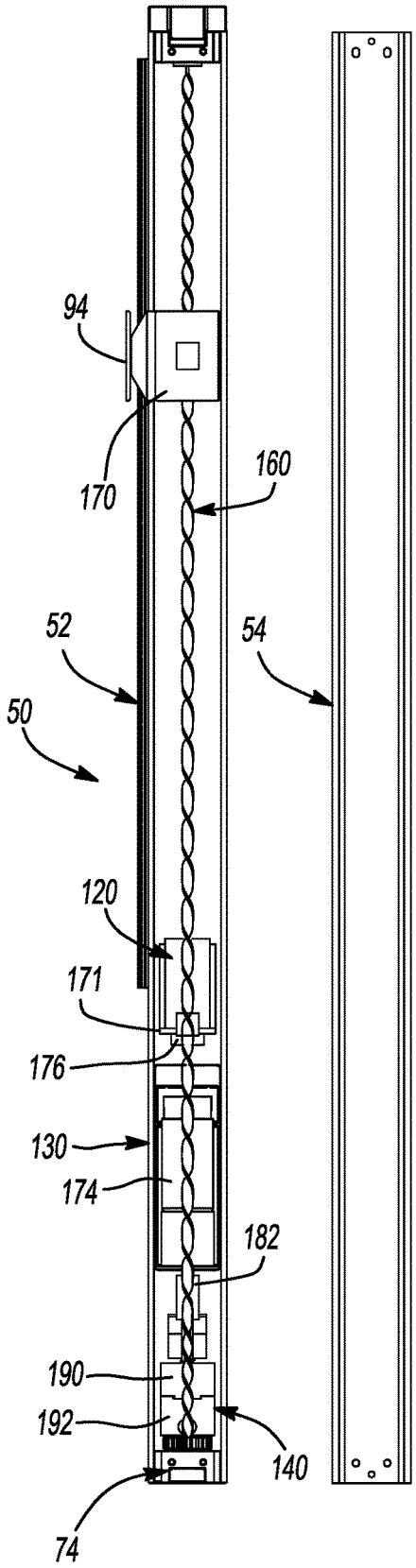
FIG. 2 is a plan view of a powered actuator with a housing open.
Figure 3:
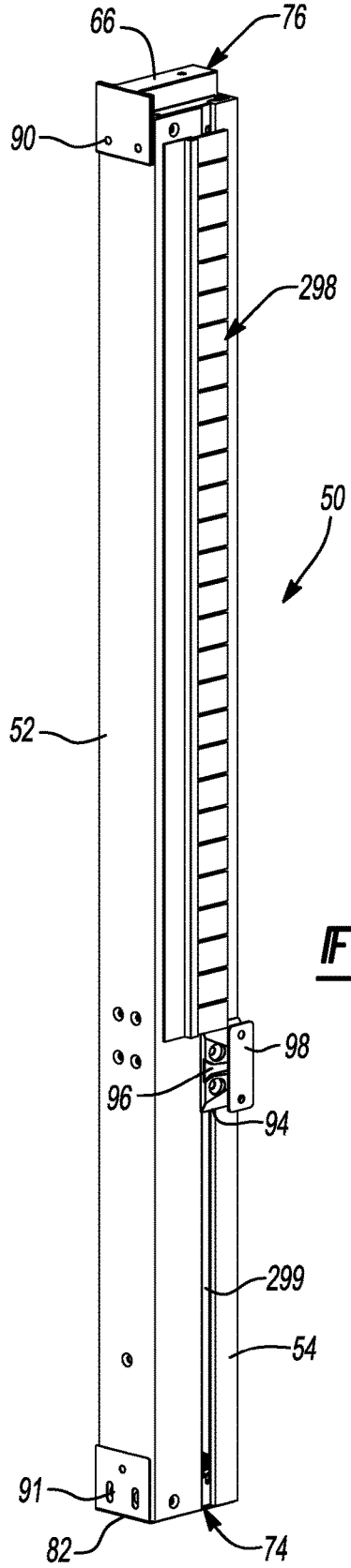
FIG. 3 is a first perspective assembled view of the powered actuator.
Figure 4:
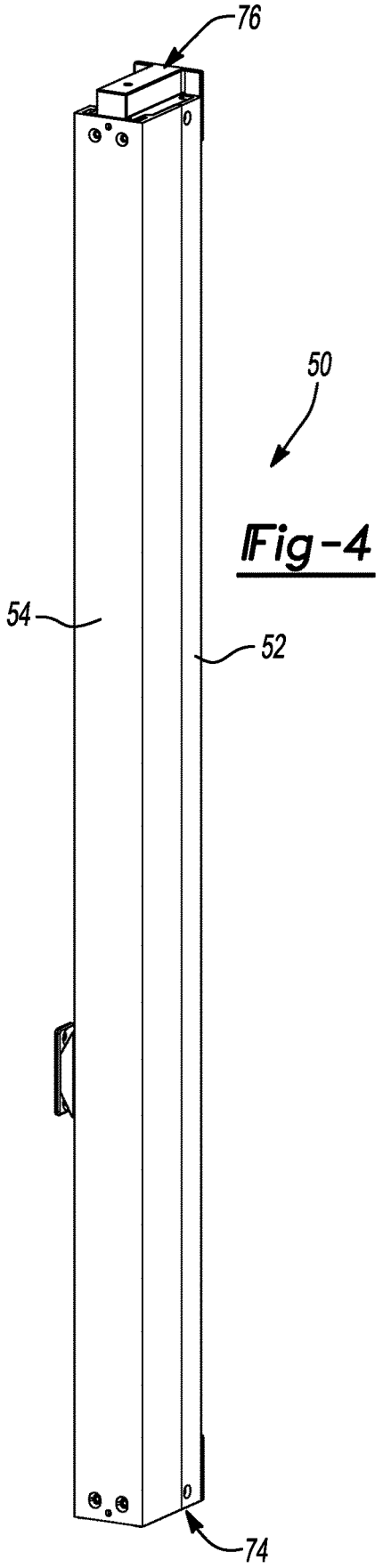
FIG. 4 is a second perspective assembled view of the powered actuator.

With additional reference to FIG. 1 and reference to FIGS. 2, 3, and 4, a powered actuator assembly 50 is illustrated. The powered actuator assembly 50 can include various portions such as an outer housing that may include a first housing member 52 and a second housing member 54. The first and second housing members 52, 54 may generally form a clamp shell that fits around various internal components, as discussed further herein. The first and second housing members 52, 54, once assembled, allows the powered actuator assembly 50 to be installed as a unit. The installation of the powered actuator assembly 50 can be generally in the second upper track 34 of the second track portion 27 and be positioned adjacent to the second door member 30, which may be a non-moving. The powered actuator assembly 50 may generally fit entirely within the second upper track 34 such that the powered actuator assembly 50 is substantially flush with the second door member 30 within the second upper track 34. In this way, the powered actuator assembly 50 is positioned relative to the frame assembly 21 and the door members 22, 30 such that the sliding door wall closure assembly 20 retains its aesthetic features. Furthermore, a surface plane of the second housing member 54 may intersect the second lower track 32 when the powered actuator assembly 50 is entirely within the second upper track 34 of the second track portion 27. The powered actuator assembly 50 may also be covered by an external fraction or trim member (not shown), if provided. The powered actuator assembly 50 may also be positioned parallel and adjacent to the movable door 22 when the movable door member 22 is in the opened and closed positions. The powered actuator assembly 50 including the first and second housing members 52, 54 does not decrease the opening 60 that is formed by moving the movable door member 22 to the opened position within the sliding door wall closure assembly 20. That is, the powered actuator assembly 50 is positioned entirely within the second upper track 34 such that the powered actuator assembly 50 does not extend into the opening 60 formed in the sliding door wall closure assembly 20 thereby permitting full access of the opening 60 when the door member 22 is in the opened position. The opening 60 may generally include a height and width and the powered actuator assembly 50 may extend less than 3 inches, in general less than about 0.5 to about 2 inches from the second track portion 27.

Figure 5:
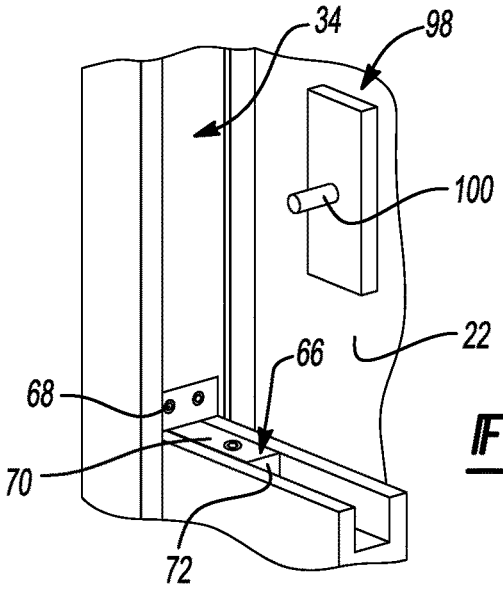
FIG. 5 is a detail environment view of a first powered actuator hanger.
Figure 6:
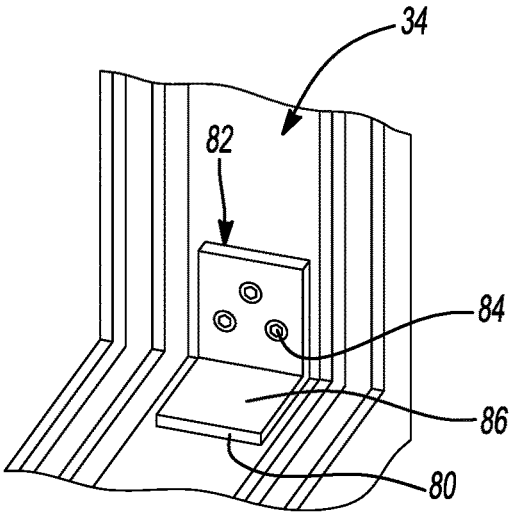
FIG. 6 is a detail environment view of a second powered actuator hanger.
Figure 8:
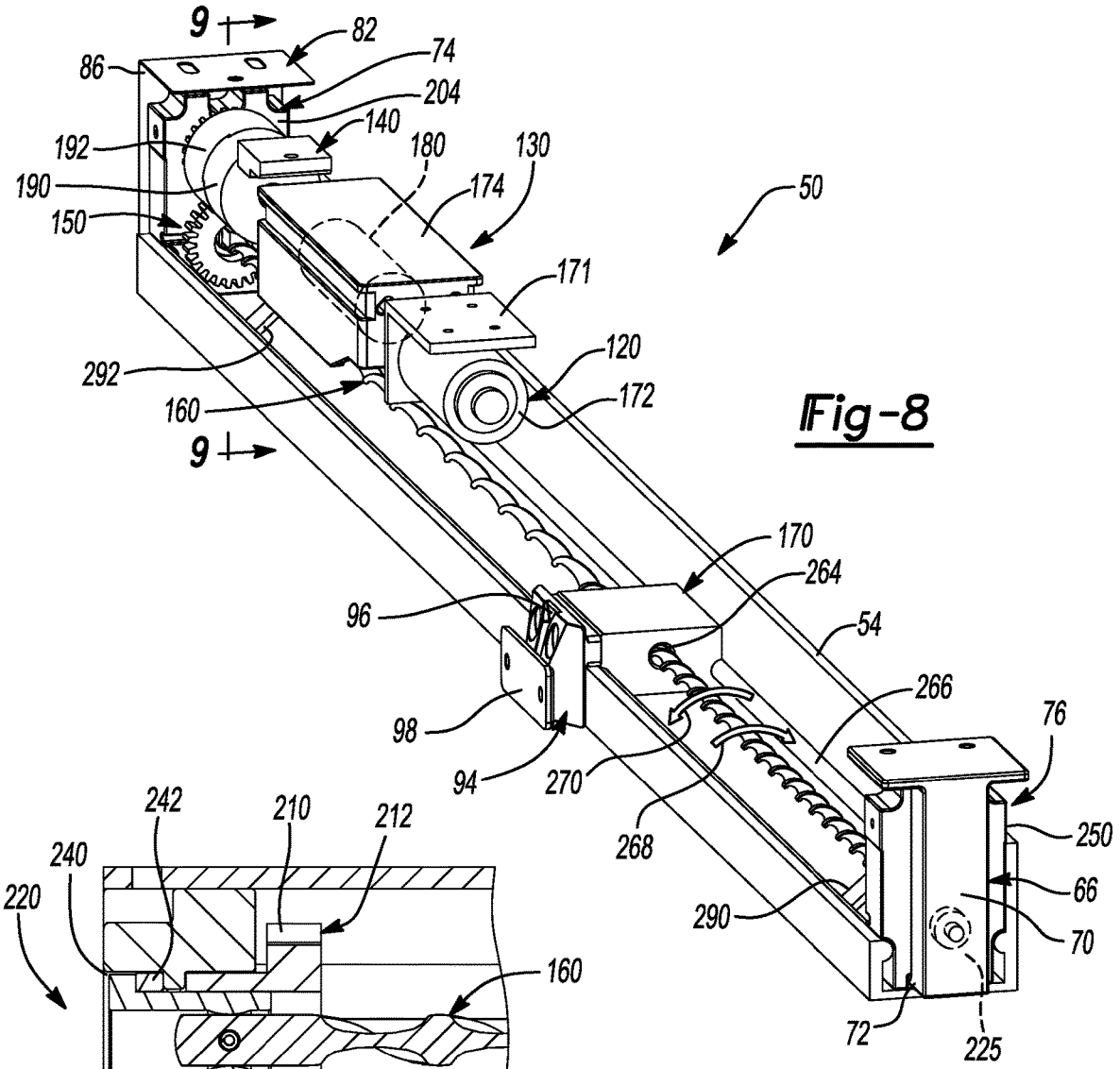
FIG. 8 is a perspective view of the powered actuator with the housing open.

With continuing reference to FIGS. 1, 2, 3 and 4 with addition reference to FIGS. 5 and 6, installation of the powered actuator assembly 50 will be described. As illustrated in FIG. 5, a fixed first hanging member 66 can be mounted into an upper surface in the second upper track 34 with fastening member 68. The fixed hanging member 66 may include a pendant portion 70 that includes a finger 72 that may extend from the pendant portion 70. The finger 72 may be engaged in a depression or opening near or at an end portion 76 of the powered actuator assembly 50. During installation, the assembled powered actuator assembly 50 can be moved to have the depression in the end portion 76 engaged with the finger 72. The depression may be formed in the second guide block or end cap 250, as illustrated in FIG. 8. A set screw in a passage 90 may be used to assist in fixation of the powered actuator assembly 50 to the fixed hanging member 66 (FIG. 3).

An opposed or opposite end portion 74 of the assembled powered actuator assembly 50 may have a second depression or opening (not shown) to receive a finger 80 of a second moveable or flexible hanger 82. The opening may be formed in a first guide block or end cap 204. The second flexible hanger 82 may be fixed to the upper surface of the second upper track 34 with a fastener 84 in a manner similar to the first hanger member 66. A pendant member 86 has the finger 80 extending therefrom, however, the pendent member 86 may be flexible or bendable relative to the second upper track 34. Therefore, the assembled powered actuator assembly 50 may be first moved to engage the first hanger member 66 and then levered or moved towards the second flexible hanger 82 while an operator or installer flexes the pendent member 86 to allow the assembled powered actuator assembly 50 to move pass the finger 80. Once the powered actuator assembly 50 is positioned relative to the finger 80, the pendant member 86 may be released to allow the finger 80 to engage the depression. It is further understood that the finger 80 may be positioned such that one of the first and second housing members 52, 54 rests on the finger 80. A set screw or a fixation member may be driven into a passage 91 of the powered actuator assembly 50 to fix the finger 80 relative to the assembled powered actuator assembly 50.

During installation, a door engaging member 94 coupled to the powered actuator assembly 50 includes a slot or receiving portion 96 that may be aligned with a projection or door pin 98 attached to the door member 22. The door pin 98 includes a protrusion 100 that is securely received within the receiving portion 96 of the door engaging member 94 thereby coupling the door member 22 and the door pin 98 to the door engaging member 94 and powered actuator assembly 50. The door pin 98 is attached to the moveable door member 22 such that the door pin 98 is positioned between the door member 22 and the powered actuator assembly 50. As discussed further herein, a connection with the door engaging member 94 and the door pin 98 can allow transfer of a force from the powered actuator assembly 50 to the moveable door member 22 to move the door member 22 in its track 24, 26.

Figure 7:
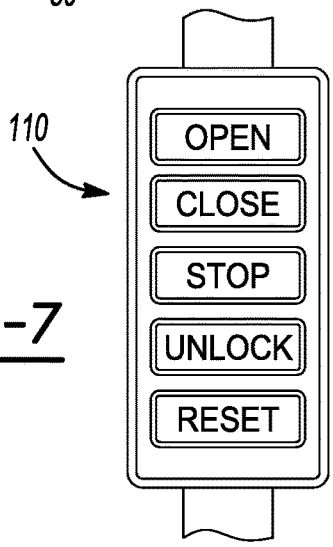
FIG. 7 is a plan view of a control switch.

The powered actuator assembly 50 can be operated with various systems, such as a manual switch 110 illustrated in FIG. 7. The manual switch 110 can include various buttons to operate the powered actuator assembly 50 to open or close the moveable door member 22, move the door member 22 to a selected location, and lock and unlock the moveable door member 22. The switch 110 can be wired to directly actuate the powered actuator assembly 50. Alternatively, or in addition to the switch 110 being wired, a wireless transmission may be made by the switch 110. Alternatively, or in addition to the switch 110, other wireless transmission systems can be used to send a signal to the powered actuator assembly 50. Wireless transmission systems may include an infrared transmitter to an infrared receiver, a data transmission protocol such as Bluetooth® data transmission, wi-fi data transmission, or other appropriate wireless data transmission protocol. The sent signal may then be received and a control signal can be made based on the receiver transmission to operate the powered actuator assembly 50.

With continuing reference to FIGS. 2, 3, and 4 and additional reference to FIG. 8 the powered actuator assembly 50 includes various components within the first and second housing members 52, 54. With initial reference to FIG. 8 the powered actuator assembly 50 is illustrated with the first housing member 52 removed to illustrate the internal components more clearly. The powered actuator assembly 50 may include, in various embodiments, a solenoid actuator 120, a motor assembly 130, a clutch assembly 140, a transmission gear assembly 150, a drive rod 160, and a drive block 170. The drive block 170 can be directly connected or coupled through an intermediate piece(s) to the door engaging member 94 such that movement of the drive block 170 moves the door engaging member 94, and when the door engaging member 94 is coupled to the door pin 98, may move the door member 22.

The powered actuator assembly 50 operates by the motor assembly 130 rotating to drive the drive rod 160. In various embodiments, however, the solenoid actuator 120 is initially actuated to move the motor assembly 130 to engage the clutch assembly 140. The solenoid actuator 120 may also be actuated to move the motor assembly 130 to disengage the clutch assembly 140.

The solenoid actuator 120 may be fixed by a bracket 171 to the first housing member 52. The solenoid actuator 120 can include a solenoid within a solenoid housing 172 that is interconnected with a motor housing 174 by a connector 176. Upon activation of a solenoid within the solenoid housing 172 the connector 176 can be moved to drive the motor housing 174 towards the end portion 74 of the powered actuator assembly 50. The movement of the motor housing 174 towards the end portion 74 can engage the clutch assembly 140, as discussed further herein. A biasing spring (not shown) may be provided to bias the motor housing 174 away from the end portion 74 such that the clutch assembly 140 is generally in a non-engaging position except for when the solenoid is activated. The solenoid can be activated via a power supply and the controller switch 110 or other controller, as discussed above. Further the power provided to the solenoid maybe through a wired connection to an external source or may be internal to the solenoid or the powered actuator assembly 50, such as with a battery.

The motor assembly 130 is positioned between the solenoid actuator 120 and the clutch assembly 140 and can include an electrical motor 180 such as a Igarashi 30 mm electrical motor. The spring is disposed between the motor 180 and the clutch assembly 140. The motor 180 can drive an axle 182 coupled thereto. The axle 182 can engage or be fixed to a first clutch member 190 of the clutch assembly 140. The first clutch member 190 may include dogs or projections (not shown) that may be received in impressions or holes (not shown) formed in a second clutch member 192 of the clutch assembly 140. The solenoid actuator 120 can be activated to move the motor housing 174, which in turns moves the motor 180, the axle 182, and the first clutch member 190, towards the end portion 74.

When the first clutch member 190 moves towards the end portion 74, the dogs engage the depressions in the second clutch member 192. Therefore, rotation of the first clutch member 190 causes rotation of the second clutch member 192. When the solenoid in the solenoid actuator 120 is disengaged the motor housing 174, the motor 180, the axle 182, and the first clutch member 190 can move away from the end portion 74 such that the dogs in the first clutch member 190 disengage from the depressions or holes in the second clutch member 192. When engaged, the clutch assembly 140 allows torque from the motor 180 to be transferred to the second clutch member 192 and when disengaged no torque is transferred from the motor 180 to the second clutch member 192.

Figure 9:
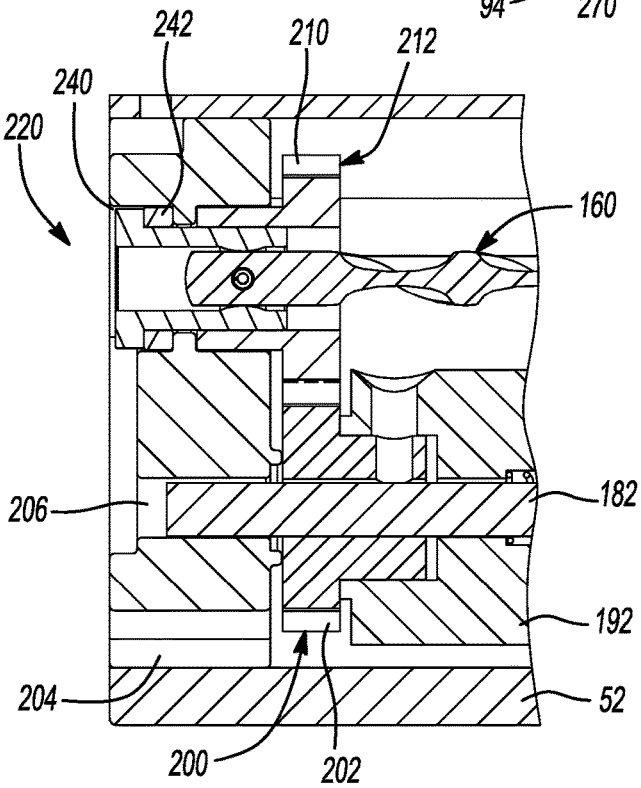
FIG. 9 is a cross-sectional view taken along lines FIG. 9-FIG. 9 in FIG. 8.

With continuing reference to FIGS. 2 and 8 and additional reference to FIG. 9 the second clutch member 192 is fixed to a first gear 200. The first gear 200 includes a plurality of teeth 202 around an exterior circumference. The axle 182 can pass through the second clutch member 192 and the gear 200 to be engaged by a cap or guiding block 204 in an axle guiding bore 206. The guiding block 204 can assist in stabilizing components, including the axle rod 182, which can pass through the clutch assembly 140 and the gear 200.

The gear 200 can rotate when the clutch assembly 140 is engaged, such as the dogs engaging the second clutch member 192 and the motor 180 is powered to rotate the axle 182. Rotation of the gear 200 causes movement of the teeth 202 that couple with a plurality of teeth 210 on a second gear 212 that may be a drive rod gear 212. As illustrated in FIG. 9, the drive rod gear 212 may be radially offset from the first gear 200. For example, the drive rod gear 212 may have a central axis that is spaced a distance from a central axis of the first gear 200. Nevertheless, due to the interaction of the teeth 202 on the first gear 200 and the teeth 210 on the drive gear 212 rotation of the first gear 200 causes rotation of the drive rod gear 212. Therefore, operation of the motor 180 can cause rotation of the drive rod gear 212.

Figure 10:
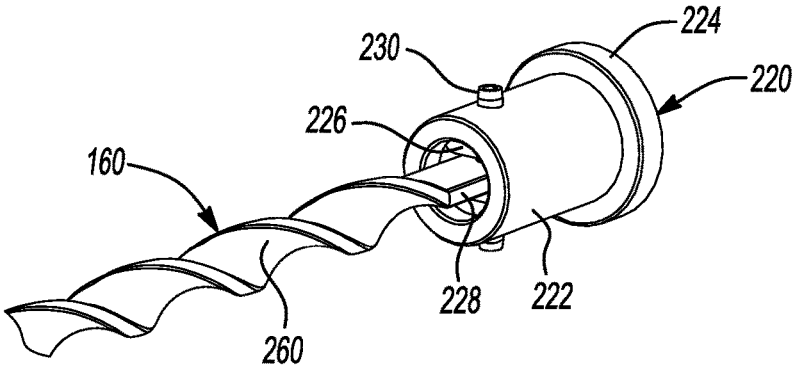
FIG. 10 is a detail perspective view of a drive rod coupling.

The drive rod gear 212 is coupled with the drive rod 160 via a rod coupling assembly 220 as illustrated in FIGS. 9 and 10. As illustrated in FIG. 10 the rod coupling assembly 220 can include an outer coupling cylinder 222 that may include a flange 224 at an end of the coupling cylinder 222. A slot 226 may be formed through the coupling cylinder 222 to receive an end 228 of the drive rod 160. The end 228 may be flattened to be received in the slot 226. Further, a spring pin or holding pin 230 may be passed through the coupling cylinder 222 to engage a bore (not shown) in the end 228 of the drive rod 160 to hold the drive rod 160 within the coupling cylinder 222. The coupling assembly 220 may be assembled in the actuator assembly 50 as illustrated in the cross section in FIG. 9.

The drive rod coupling assembly 220 may be positioned within a bore 240 formed in the guide block 204. A bushing or bearing member 242 can be provided on a selected side of the rod coupling assembly 220. Further the rod coupling assembly 220 can be fixed to the gear 212 according to appropriate mechanism, such as by welding, adhesive, mechanical connections, including rivets, screws of the like. Therefore, rotation of the gear 212 may cause rotation of the drive rod 160 by rotating the rod coupling assembly 220 because the drive rod 160 is received within the slot 226 and, therefore, held fixed relative to the rod coupling assembly 220 by the slot 226 and the pin 230.

Rotation of the gear 200 causes rotation to the gear 212 to, in turn, rotate the drive rod 160. The drive rod 160 may not be tightly held within the rod coupling assembly 220 but may be allowed to move a small amount, such as about 1° to about 2° or rotation relative to a central axis of the rod coupling assembly 220. Therefore, strain on the drive rod 160 may be relieved if the drive rod is over rotated. Further, a rod coupling assembly 225 may be positioned in the second guide block 250 that is near the opposite end portion 76 of the actuator assembly 50. The rod coupling assembly 225 may be coupled to the drive rod 160 in a similar manner as the rod coupling assembly 220 described above. Therefore, the drive rod 160 may be rotationally coupled to both ends 74, 76 of the powered actuator assembly 50.

The drive rod 160, therefore, can rotate when powered by the motor 180 through the clutch assembly 140 and the gears 200 and 212 via the couplings 220, 225, as discussed above. The drive rod 160 includes a spiral 260 and the drive block 170 has a bore 264 through which the drive rod 160 is passed. Rotation of the drive rod 160 causes rotation of the spiral 260 and the drive block 170 engages the spiral 260 and moves along a track 266 formed within the second housing member 54. It is understood that the track 266 is not required and that the drive block 170 may move along the second housing member 54 without the track 266.

The door member 22, or other moveable member, may be driven in at least two directions with the drive rod 160 and drive block 170. Rotation of the drive rod 160 in a first direction, such as in direction of arrow 268, selectively determines the direction of movement of the door member 22 in a first direction (such as towards the end portion 76), by operating the motor 180 with the switch 110 in the first direction. The drive rod 160 may also be driven in a second direction, such as the direction of arrow 270. The second direction 270 of rotation causes the drive block 170 to move in an opposite direction such as towards end portion 74. As discussed above, the drive block 170 is connected to the door engaging member 94 and therefore can move the door member 22 once coupled to the door pin 98 in the selected directions.

Various sensors and control mechanisms can also be included within the actuator assembly 50. For example, limit or position sensors, such as reed switches 290 and 292 may be coupled to controllers to provide a selected position or an end point within the first and second housing members 52, 54. It is also understood that other selected sensors may be provided to identify a discreet location of the drive block 170 along the length of the first and second housing members 52, 54 and may be used to assist in controlling the motor 180.

Accordingly, as discussed above, the actuator assembly 50 may be installed relative to the door member 22 to allow for powered movement of the door 22. In addition, it is understood that the actuator assembly 50 may be installed relative to windows, such as a double hung window, to engage a window sash and move a window sash in a similar manner according to the mechanism as described above. It is further understood that variations of the actuator assembly 50 may be provided without varying the scope of the appended claims. For example, a direct drive of the drive rod 160 may be provided without including the two drive gears 200 and 212 that are radially offset from each other. In addition, alternative clutch systems may be provided rather than the dog clutch as discussed above. Nevertheless, the actuator assembly 50 may be installed in a door assembly to move the moveable door member 22. Further the actuator assembly 50 may include additional elements such a dust guard or cover 298 that can at least cover up a portion of a slot 299 formed through the first and second housing members 52, 54 including the slot 96 that allows the door engaging member 94 to couple to the driving block 170 that is internal to the first and second housing member 52, 54.

The drive rod 160, having the spiral 260, may have a varying pitch spiral (i.e., twists per unit length) along the length of the rod 160. For example, a small pitch of the spiral 260, such as a pitch of about 0.5 inches to about 1.5 inches may be provided near the end of the drive rod 160, such as the end 228. Near a middle of the drive rod 160 a larger pitch of the spiral 260 may be included. The larger pitch may be about one inch to about four inches. In various embodiments, it is understood, however, that a constant pitch may be provided. The variation in pitch may allow a variable speed of the drive block 170 or torque applied thereto. The smaller pitch may apply a larger torque to the drive block 170 with a power from the motor 180 that is the same as the power provided when the drive block 170 is near the middle of the drive rod 160 having the larger pitch.

Figure 11:
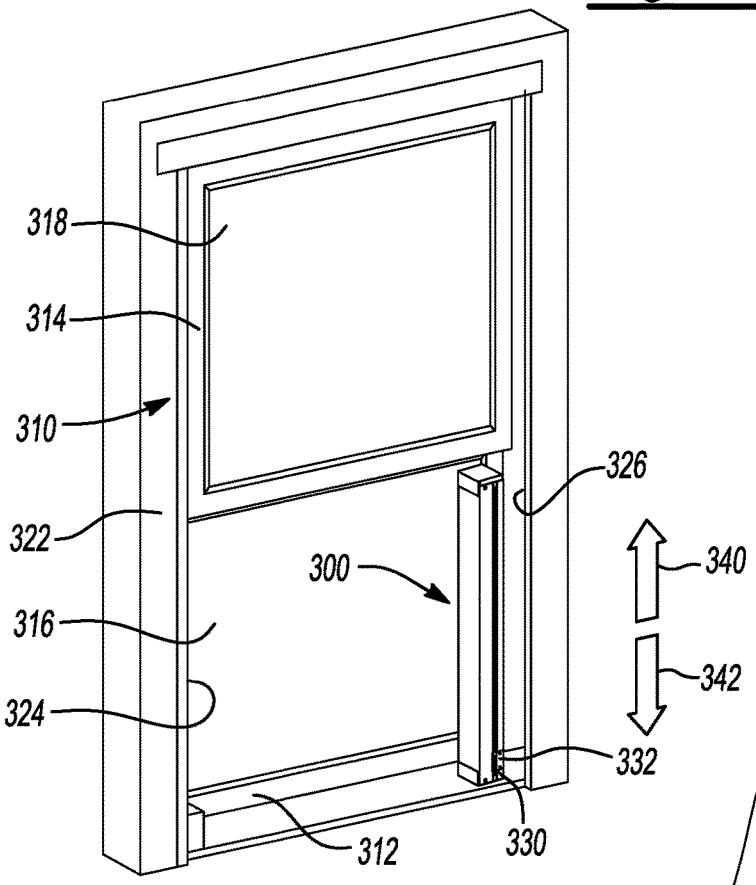
FIG. 11 is an environmental view of a window assembly with a powered actuator.
Figure 12:
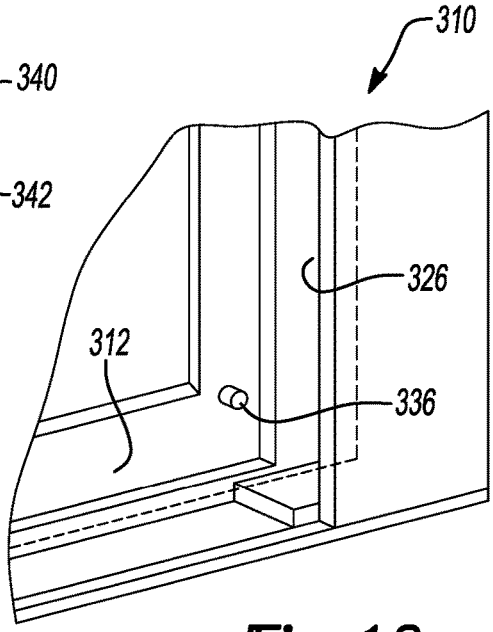
FIG. 12 is a detail view of the window assembly of FIG. 11.

With reference to FIGS. 11 and 12, as noted above, a power actuator 300 may be installed relative to a sliding window closure assembly 310. The sliding window closure assembly 310 may include a single- or double-hung window having a first sash or closure panel 312 and a second sash or closure panel 314. Each of the sashes 312, 314 may include a window pane 316 and 318, respectively. At least one of the sashes, such as the first sash 312, may be moveable. As illustrated in FIG. 11, the first sash 312 is moveable relative to the second sash 314. The first sash 312 may be slide along a jamb channel, as is generally understood by one skilled in the art.

Formed by a window frame 322 may be the jamb channel including a left track portion 324 and a right track portion 326. The powered actuator 300 may be installed in one of the track portions, such as the right track portion 326. The powered actuator 300 may be substantially similar to the powered actuator assembly 50 discussed above and illustrated in FIGS. 2 to 10. The powered actuator 300 installed in the right track portion 326 can include portions as discussed in relation to the powered actuator assembly 50 including a motor, clutch assembly, drive rod, and driving member similar to those discussed above. The powered actuator 300 may further include a window engaging member 330 that includes a slot or pin receiving region 332 that may receive and/or engage a pin or window member 336.

The powered actuator 300 may be installed in a manner similar to the powered actuator assembly 50. The powered actuator 300 can be installed into the right track portion 326 such that the pin 336 is received within the slot 332 of the window engaging member 330. As discussed above a controller, such as a switch or transmitter, similar to the switch 110 or transmitters discussed above, can then be used to activate the powered actuator 300.

Upon activation of the powered actuator 300 the first sash 312 may be moved to open and form create an opening through the frame assembly 322. The opening may be defined as an opening cleared by the sash 312. Further, the powered actuator 300 can be installed in the right track portion 326 such that it does not substantially decrease the design opening through the frame assembly 322. As discussed above, the powered actuator 300 may be installed in the right track portion 326 and engage the pin 336 such that it does not extend beyond a track wall a substantial distance, such as no greater than about 0.1 inches to about 1 inches.

The powered actuator 300 can be operated to open and close the sliding window closure assembly 310. In so doing, the powered actuator 300 can operate to move the sash generally in the direction of arrow 340 when operated in first direction and may also move the window in the direction of arrow 342 when operated in a second direction. As discussed above, the motor included in the powered actuator assembly 50 can operate in a forward and reverse manner to move a door member in two directions. The motor included in the powered actuator 300 may also be operated in a forward and reverse manner to move the window sash 312 in both directions 340, 342.

The drive rod included in the powered actuator 300 may include a variable or constant pitch, as discussed above. For example, a constant pitch drive rod in the powered actuator 300 may provide a constant speed of movement of the window sash 312 along its total travel length, given a constant rate of speed form the motor. Therefore, the window may be opened and closed by moving the sash 312 at a substantially known rate. The weight of the sash 312 may assist in forming a seal of the sliding window closure assembly 310 when moving towards the closed position.

In light of the above, it is understood that the powered actuator 300 and the powered actuator assembly 50 may be used to move various assemblies. It is further understood that side sliding windows may also be operated with the powered actuator 300 if the powered actuator 300 is installed to move a selected sash or window pane in a side sliding manner. The window engaging member 330 can engage a pin in a side sliding window to move in a side sliding window in a manner similar to the door member 22 as discussed above in the door wall assembly 20. Accordingly a powered actuator, according to various embodiments, can be installed to be relatively unobtrusive relative to a designed or pre-formed opening in an assembly by installing the powered actuator in track portions of immovable or selectively immovable door or window members.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A sliding closure assembly, comprising:

a first panel moveable in a first direction to an opened position which provides an opening through the sliding closure assembly, and in a second direction to a closed position which closes the opening through the sliding closure assembly;

a frame assembly including a first track portion and a second track portion, the first track portion facing the opening through the sliding closure assembly and comprising first and second opposing, spaced-apart parallel planar surfaces;

wherein the first panel is disposed between the first and second planar surfaces of the first track portion of the frame assembly and slides within the first track portion between the opened position and the closed position; and a powered actuator assembly for moving the first panel between the opened position and the closed position, the powered actuator assembly being mounted to the frame assembly at a position adjacent to one of the first and second opposing, spaced-apart parallel planar surfaces of the first track portion;

wherein the powered actuator assembly is mounted in the second track portion.

2. The sliding closure assembly of claim 1, wherein the second track portion receives a second panel, wherein the first and second track portions are disposed in a side-by-side parallel relationship, and wherein the first panel is moveable relative to the second panel.

3. The sliding closure assembly of claim 2, wherein the powered actuator assembly is substantially flush with the second panel and does not project into the space between the two surface planes of the first track portion.

4. The sliding closure assembly of claim 2, wherein each of the first and second track portions has a jam channel and wherein the powered actuator assembly is installed in the jam channel of the second track portion.

5. The sliding closure assembly of claim 1, wherein the powered actuator assembly is spaced from the first panel in a direction that is transverse to first and second opposing, spaced-apart parallel planar surfaces of the first track portion.

6. The sliding closure assembly of claim 5, wherein the power actuator assembly includes an engaging member that is coupled to the first panel and wherein the power actuator assembly includes a motor that is configured to power movement of the engaging member and drive the first panel in the first and second directions between the opened and closed positions.

7. The sliding closure assembly of claim 6, wherein the powered actuator assembly further comprises:

a drive rod;

a clutch assembly selectively coupling the motor and drive rod; and a drive block moveable by the drive rod and coupled to the engaging member.

8. The sliding closure assembly of claim 7, wherein the drive rod includes a spiral that engages the drive block such that rotation of the drive rod in a first rotational direction causes the drive block to move towards a first end of the drive rod and rotation of the drive rod in a second rotational direction causes the drive block to move towards a second end of the drive rod.

9. The sliding closure assembly of claim 8, wherein the drive rod spiral has a variable pitch where the pitch of the drive rod spiral near each of the first and second ends of the drive rod is different than the pitch of the drive rod near a middle portion of the drive rod.

10. The sliding closure assembly of claim 6, wherein the engaging member is coupled to one of a front surface or a back surface of the first panel.

11. The sliding closure assembly of claim 1, wherein the powered actuator assembly is arranged in a side-by-side parallel relationship with the first panel and is not positioned above or below the first panel.

12. The sliding closure assembly of claim 1, wherein the first panel comprises one of a sliding door or a sliding window sash.

13. A sliding closure assembly comprising:

a frame assembly having a first track portion and a second track portion, the first track portion of the frame assembly comprising a first lower track and a first upper track and the second track portion of the frame assembly comprising a second lower track and a second upper track;

the first lower track and the first upper track defining two surface planes that are parallel to one another;

a first panel that slides within the first track portion of the frame assembly in a first direction towards an opened position and in a second direction towards a closed position, wherein an opening is formed through the sliding closure assembly when the first panel is in the opened position and wherein the opening is closed when the first panel is in the closed position;

a second panel positioned in the second track portion of the frame assembly; and a powered actuator assembly mounted to the frame assembly in the second track portion at a position adjacent to the first track portion such that the powered actuator assembly is positioned outside the space between the two surface planes of the first track assembly.

14. The sliding closure assembly of claim 13, wherein the second lower track and the second upper track define two surface planes that are parallel to one another and wherein the power actuator assembly is positioned between the two surface planes of the second track assembly.

15. The sliding closure assembly of claim 13, wherein the first panel comprises one of a sliding door or a sliding window sash.

16. A sliding closure assembly, comprising:

a frame assembly having a first track portion and a second track portion;

a first panel that slides within the first track portion of the frame assembly in a first direction towards an opened position and in a second direction towards a closed position, wherein an opening is formed through the sliding closure assembly when the first panel is in the opened position and wherein the opening is closed when the first panel is in the closed position;

a second panel adjacent to the first panel and positioned within the second track portion of the frame assembly; and a powered actuator assembly positioned adjacent to the second panel and disposed within the second track portion, the powered actuator assembly comprising a motor configured to drive a drive rod, a drive block that is coupled to the first panel and is moveable by the drive rod in the first and second directions relative to the motor, and first and second housing members that form a shell around at least the motor and the drive rod allowing the powered actuator assembly to be installed in the second track as a single unit.

17. The sliding closure assembly of claim 16, further comprising:

a first hanging member and a second hanger mounted in the second track portion, the first hanging member and the second hanger each including a finger, wherein the powered actuator assembly has opposing end portions, each end portion including a depression configured to receive the fingers of the first hanging member and the second hanger.

18. The sliding closure assembly of claim 16, wherein the drive block engages the drive rod such that rotation of the drive rod in a first rotational direction causes the drive block to move to a first end of the drive rod and rotation of the drive rod in a second rotational direction causes the drive block to move to a second end of the drive rod thereby causing the first panel to move between the opened position and the closed position, wherein the drive rod includes a spiral extending along its length, and wherein the spiral has a variable pitch so as to allow variation of the speed of the drive block along the drive rod and a variation of the torque applied to the drive block by the drive rod.

19. The sliding closure assembly of claim 16, wherein the powered actuator assembly further comprises a clutch assembly rotatably coupling the motor and the drive rod, the clutch assembly including a first clutch member, a second clutch member, and a spring, the first clutch member including dogs configured to be received in holes in the second clutch member.

* * * * *